US005357797A

United States Patent [19]

Maki, Jr. et al.

[11] Patent Number: 5,357,797

[45] Date of Patent: Oct. 25, 1994

[54] METHOD AND APPARATUS FOR CORRECTING MWD POROSITY MEASUREMENT

[75] Inventors: Voldi E. Maki, Jr.; Michael L. Gartner, both of Austin, Tex.

[73] Assignee: Halliburton Logging Services, Inc., Houston, Tex.

[21] Appl. No.: 125,499

[22] Filed: Sep. 22, 1993

Related U.S. Application Data

[63] Continuation of Ser. No. 717,236, Jun. 18, 1991, abandoned.

[51] Int. Cl.[5] ..... E21B 47/08; E21B 49/00; G01V 5/04

[52] U.S. Cl. ..... 73/152; 250/264; 250/266; 166/250

[58] Field of Search ..... 73/152, 153; 166/250; 250/264, 266

[56] References Cited

U.S. PATENT DOCUMENTS

| | | | |
|---|---|---|---|
| 3,784,822 | 1/1974 | Schuster | 250/266 |
| 4,047,027 | 9/1977 | Bateman et al. | 250/266 |
| 4,129,777 | 12/1978 | Wahl et al. | 250/266 |
| 4,596,926 | 6/1986 | Coope | 250/266 |
| 4,661,933 | 4/1987 | Seeman et al. | 367/27 |
| 4,791,797 | 12/1988 | Paske et al. | 73/152 |
| 4,794,792 | 1/1989 | Flaum et al. | 73/152 |
| 4,864,129 | 9/1989 | Paske et al. | 250/266 |
| 4,972,082 | 11/1990 | Loomis et al. | 250/266 |
| 5,091,644 | 2/1992 | Minette | 250/254 |
| 5,130,950 | 7/1992 | Orban et al. | 367/34 |
| 5,159,577 | 10/1992 | Twist | 367/25 |
| 5,175,429 | 12/1992 | Hall, Jr. et al. | 250/262 |
| 5,214,251 | 5/1993 | Orban et al. | 181/102 |

*Primary Examiner*—Hezron E. Williams
*Assistant Examiner*—George Dombroske
*Attorney, Agent, or Firm*—Arnold, White & Durkee

[57] ABSTRACT

A porosity measuring MWD system utilizing a source and two detectors is set forth. The source and two detectors are preferably mounted in a stabilizer fin on a drill collar. A standoff measuring device is also included. Dependent on dynamically measured standoff, output pulses from the two detectors are input to storage counters; different counters are selected for different ranges of standoff. Porosity measurements are determined from the counts for variations in standoff measurements; this provides a near/far ratio for ranges of standoff; as the standoff range varies, the counts are directed to different counters. Near/far ratios are determined and represent the apparent porosity; a corrected value of porosity is then determined for each particular range of standoff.

6 Claims, 4 Drawing Sheets

METHOD AND APPARATUS FOR CORRECTING MWD POROSITY MEASUREMENT

This application is a continuation of application Ser. No. 07/717/236, filed Jun. 18, 1991, now abandoned.

BACKGROUND OF THE DISCLOSURE

The present disclosure is directed to a method and apparatus for correcting the MWD porosity for standoff between the tool and the sidewall of the borehole. This is particularly intended for use with a tool which is constructed in a drill collar equipped with a lengthwise stabilizer fin. The stabilizer fin is provided with an ultrasonic measuring signal which transmits a signal radially outwardly which is reflected back to the transducer of the ultrasonic device so that a measurement of spacing can be obtained. The sidewall of the borehole is normally represented as an idealized circular surface; in reality, it is not circular but is an irregular surface which varies irregularly in spacing from the drill collar which supports the MWD tool. The stabilizer fin can either be helical or straight along one side of the drill collar; indeed, many drill collars are made with two or three stabilizer fins in helical form extending around and along the drill collar. The ultrasonic standoff detector measures spacing between the stabilizer fin and the adjacent wall of the borehole so that standoff can then be determined.

Porosity is ordinarily measured by positioning in the stabilizer fin some type of radiation source and a pair of spaced detectors responsive to the source. The source cooperates with the two detectors which provide a detected count rate at each of the two detectors. The count rate is normally dealt with by determining a ratio between the counts from the near and far detectors, and this ratio is normally represented as the ratio of N/F. The N/F ratio is a relative value and hence cancels from the numerator and denominator equally any variations which might arise from changes in source intensity or other scale values which might cause variations in absolute measurements. This is desirable so that the value of the N/F ratio can be correlated to a porosity measurement for a particular formation adjacent to the well borehole. The correlation between the ration N/F and the porosity is determined from measurements made in standard calibration facilities with no standoff. Deviations from the true porosity occur when the standoff is not zero. If the standoff is not zero the apparent porosity can be corrected to obtain a measure of the true porosity may be nonlinear.

The context in which the MWD equipment is used must also be noted. That is, the MWD equipment described herein is mounted in a drill collar which is rotating at the time that measurements are taken. In light of the fact that the tool is rotating and the hole is not perfectly round, the standoff may fluctuate radically several times during one revolution. The rate of change can be quite high and is irregular in nature. Moreover, a simple average value of standoff cannot be used to obtain a correct measurement of porosity because the correction based on standoff may not be linear. The present invention sets forth both a method and apparatus by which the standoff is measured repetitively during rotation and different values are obtained for such measurements. In fact, the standoff measurements are used to steer pulse counts occurring at that interval into specified detector registers or counters. Recall that the porosity is normally determined by irradiating the adjacent formation from the radioactive source and detecting responsive counts at both gamma ray detectors. The counts are thus stored in different counters; similar replicated sets of counters are provided for the counts from both the near and far detectors. The counts are thus stored in their respective counters, and the two sets of counters are then matched to obtain the N/F ratio for each of the respective counters in the two sets. For instance, if there are eight near counters, there should likewise be eight far counters; the near counters as well as the far counters are designated in relation to the particular standoff distance when the counts occur. This enables several different ratios to be obtained but they are more true in light of the fact that standoff matching does occur, and with this, the several counters provide several ratios. This then yields several values of porosity and these values may be averaged to provide porosity of the formation. This avoids error arising from the nonlinear relationship between the N/F ratio and standoff distance.

In the preferred embodiment, the present structure utilizes a standoff sensor which measures the distance from the MWD porosity measuring equipment to the sidewall, and provides a signal indicative of spacing. As spacing is varied, counts occurring at that spacing are steered to different counters. Preferably, the near detector as well as the far detector are both connected to equal sets of counters; both sets preferably are equal so that two sets have n counters each (where n is a whole number integer) and that in turn enables the formation of n ratios (N/F) which each are then corrected to provide a weighted average porosity.

It should be noted here that this method is applicable also if the commonly-used technique of depth shifting is used in the processing. This technique involves combining the far detector count rate, obtained with the tool at one depth, with the near detector count rate, obtained with the tool at a greater depth, to form the ratio N/F. Depth shifting is used to eliminate anomalously large porosity estimates near stratigraphic bed boundaries. The standoff correction method disclosed herein can be used along with depth shifting if count rates are recorded and stored as a function of standoff for use with count rates recorded as a function of standoff during a subsequent counting period. The ratio N/F is then formed by combining the far detector count rate corresponding to a given standoff with the near detector count rate corresponding to the same standoff distance, but from a previous counting period.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
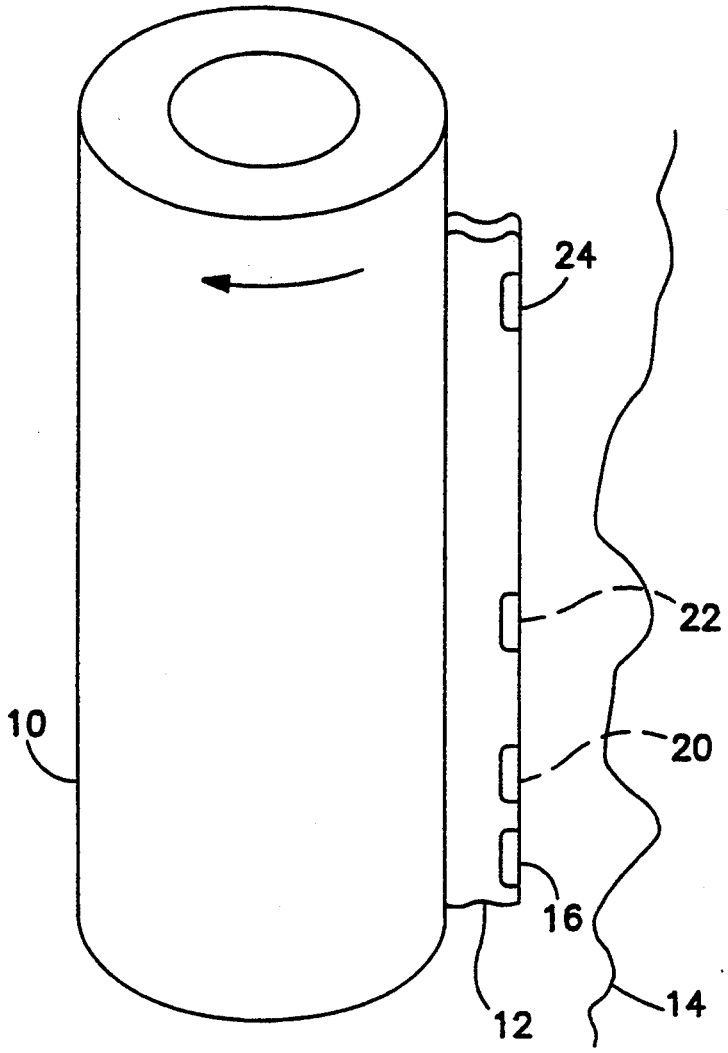
FIG. 1 shows a drill collar supporting a stabilizer fin which is constructed with an ultrasonic standoff detector, a source and cooperative near and far detectors for measuring porosity where the spacing to the borehole is variable.

Attention is now directed to FIG. 1 of the drawings where a drill collar 10 is illustrated for rotation to the right or clockwise as viewed from above, as is customary for drilling an oil or gas well with a drill bit (not shown) suspended at the lower end of a drill stem including the drill collar 10. The drill collar 10 is constructed with a stabilizer fin 12. It is common to utilize a straight fin of finite width and height extending outwardly from the drill collar. Indeed, two or three fins are ordinarily placed on most collars. Alternately, the fin can wrap around the drill collar in a helical curve. In either case, the drill collar straighten the well borehole as a result of the stabilizer fins which guide the drill collar in the well as it is drilled deeper. The well is often represented as having an idealized cylindrical sidewall. In fact, it is rarely cylindrical and it is usually a rugged irregular surface of the sort exemplified with the sidewall 14 in FIG. 1. There, it will be observed that the standoff spacing is variable in light of the fact that the sidewall of the borehole can vary. As will be further understood drilling occurs while the drill collar is continuously rotated and measurements are continuously made utilizing the MWD porosity measurement tool as will be described.

The fin 12 supports a transducer (preferably a transceiver) 16 which is positioned to transmit radially outwardly an acoustic signal which is returned to the transducer. This transmission of an outwardly directed signal and the radial return of that reflected signal is used to measure standoff. The elapsed time of transmission is converted into a measurement of standoff. Ordinarily, the standoff is in the range of perhaps one inch and typically much less. Accordingly, standoff is represented in the ordinate of FIG. 2 as being one inch or less in a typical size borehole.

Figure 3:
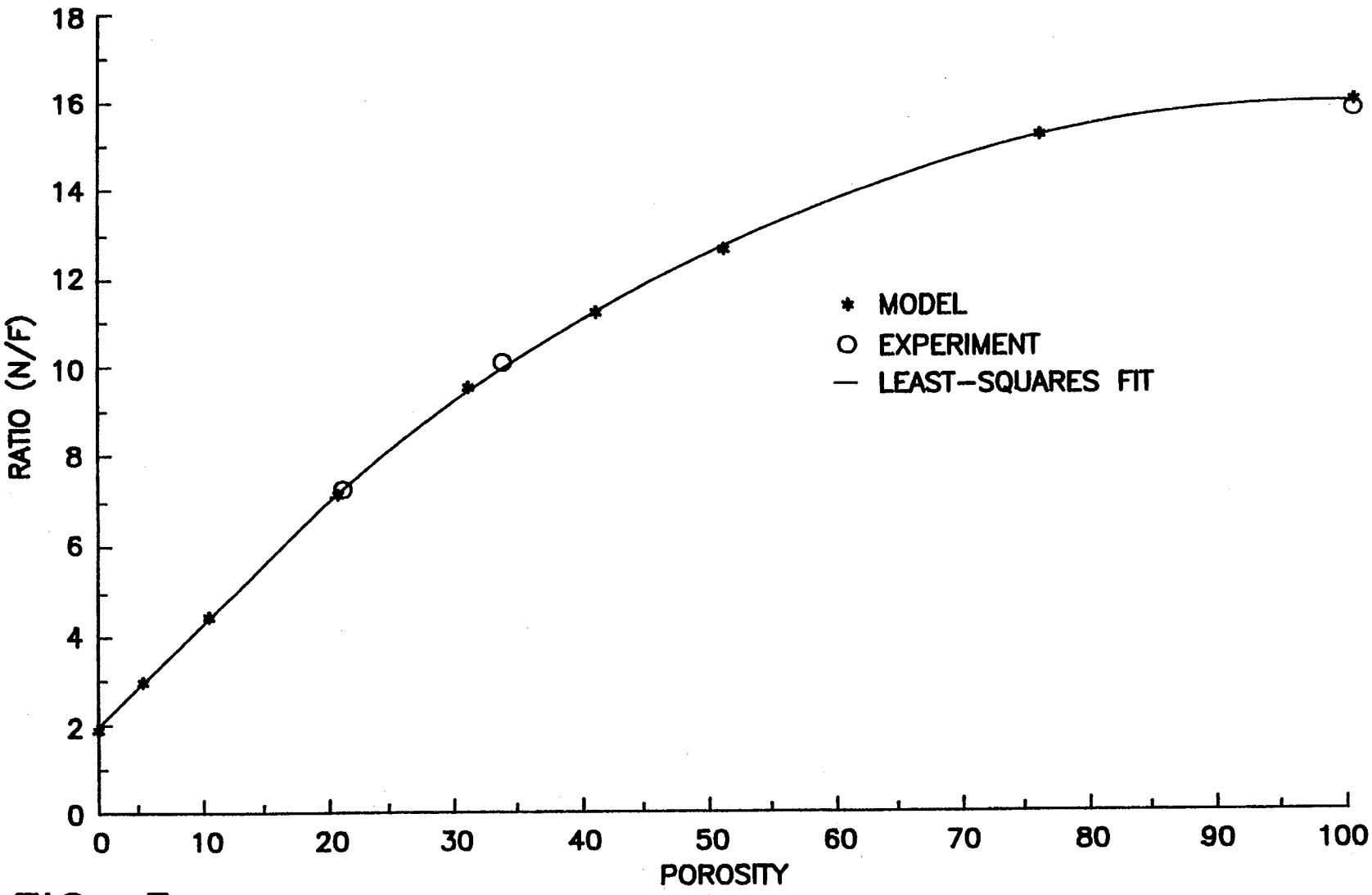
FIG. 3 shows a ratio of near to far detector in one dimension and the MWD determined porosity for a particular formation.

Continuing with FIG. 1, a radioactive source 20 provides radiation which is detected by a near detector 22 and a far detector 24. The spacing of the source to the detectors is a scale factor which is determined by a number of key factors such as the strength of the source, sensitivity of the detectors and the like. The count rate at the detector 22 is greater, and is typically much greater than the count rate at the detector 24. This spacing is used to form the N/F ratio which is shown as the ordinate of FIG. 3. This ratio enables conversion of the dynamically measured value of N/F to the porosity in accordance with the curve shown in FIG. 3. Porosity is represented in porosity units in the conventional fashion.

Figure 2:
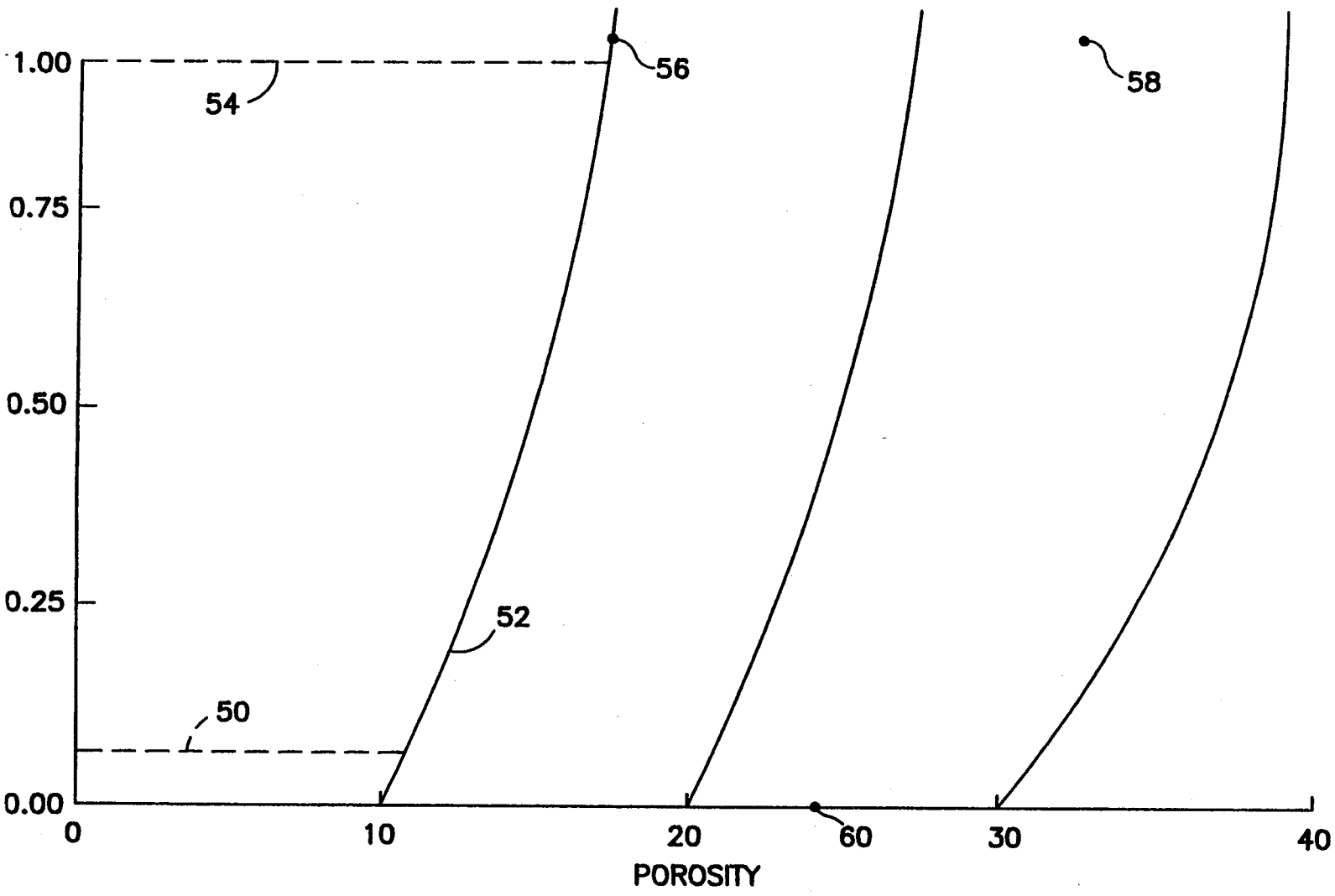
FIG. 2 is a graph showing the effect of standoff on porosity which in particular shows that it is a nonlinear relationship.

Going back to FIG. 2 of the drawings, it will there be noted that an apparent porosity of 10 p.u. is a true measurement when the standoff is nil, but is erroneous as the standoff increases towards one inch. Variations in standoff change the true porosity measurement into an apparent value which must be corrected. As will be observed from the shape of the curves, the correction is not linear except with certain approximations for certain values.

Figure 4:
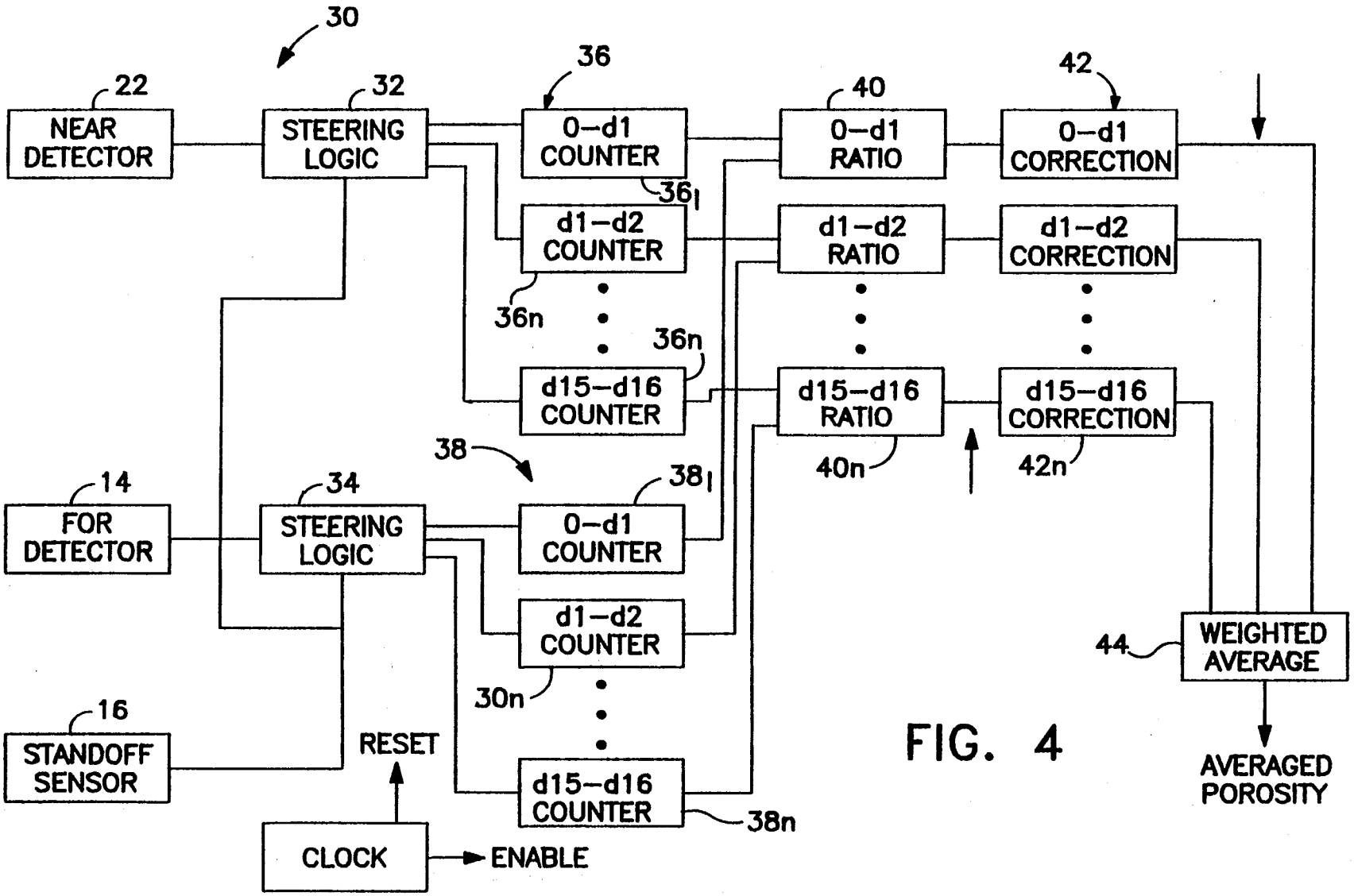
FIG. 4 is a schematic block diagram of the apparatus utilized for measuring standoff adjusted values of porosity using MWD porosity measuring apparatus.

The porosity which is output from the system is an apparent porosity measurement which is not readily corrected if the standoff is not known. The present system overcomes this handicap. Attention is now directed to FIG. 4 of the drawings where the numeral 30 identifies the apparatus of the present disclosure. Again, the near detector 22 is illustrated. The far detector 24 is likewise incorporated, and the standoff sensor 16 is likewise illustrated. The near detector provides a procession of output pulses which are delivered to a steering logic circuit 32. A duplicate circuit 34 is likewise provided for the far detector. There is a set of n similar counters 36; a similar set is also included at 38. Preferably the counters 36 and 38 are identical in construction and are equal in number. The number of counters is preferably at least two and is a whole number integer as will be detailed. The counter $36_1$ provides an output which is applied to a ratio detector 40. The second and other input from the far detector 24 is received from the corresponding far counter $38_1$. In the foregoing, the subscript 1 indicates the first counter of the n series where n is a whole number integer and is preferably two or more. The number n may increase to any level; for instance, n can be eight, twelve, fourteen, etc. Whatever the number of n, there are an equal number of ratio circuits at 40. In like fashion there is a similar number of n output correction circuits at 42. These provide the porosity value; since there are n of these circuits, they are all input to an averaging circuit 44 to calculate an output of averaged porosity.

Going back to the number n, it will be observed that the standoff distance in FIG. 2 ranges from one inch down to zero. This interval can be divided into four ranges of standoff, for instance, where each range is equal and each range is 0.25 inches. For even greater definition, eight or sixteen can be used for n. Assuming that n is sixteen, standoff distances in the range of 0.00 to 0.0625 inches are below the line 50 shown in FIG. 2 of the drawings. Utilizing this range, the curve 52 which correlates actual porosity to apparent porosity can be segmented into a straight line approximation. At any instant that the standoff is in this range, counts received at the near and far detectors 22 and 24 are steered by the logic circuits at 32 and 34 to be stored in the counters at $36_1$ and $38_1$.

By contrast, assume that the standoff is in the maximum range which is anticipated or one inch. The line 54 separates that range of standoff, namely 15/16 of an inch or a range of at least 0.9375 inches. Again, this range is above the line 52 and provides a region which is a straight line segment which has an approximation which is linear. If the standoff is in this range, the data from the two detectors is input to the counters at $36_{16}$ and $38_{16}$. This data is then provided to the ratio circuit $40_{16}$ for determination of the ratio, and that is then provided to the correction circuit $42_{16}$ to determine the correct ratio. An example will show how this works. Assume in operation that the drill stem is being rotated at a specified velocity and during rotation the standoff is instantly at least 0.9375 inches. At that instant, a signal indicating this value of standoff is formed by the standoff transducer 16. This operates the steering logic circuits 32 and 34 to direct output pulses from the two detectors 22 and 24. These pulses are then momentarily directed to the counters at 3616 and 3816. The data in the form of pulses is stored at these two particular counters.

The data in the two sets of n counters is then accumulated for an interval. Assume for purposes of discussion that the interval is ten milliseconds. A reset pulse is formed by a clock along with an enable pulse also formed by the clock. The enable pulse is applied to the n ratio circuits at 40 to enable them to receive the stored count values. At any particular ratio circuit $\mathbf{40}_n$, the two counts from the counters $\mathbf{36}_n$ and $\mathbf{38}_n$ are then input. The inputs of the two count values are sufficiently long that the N and F count values are successfully received to enable a ratio to be determined. In the ratio circuit $\mathbf{40}_n$, this ratio is then determined. Assume for purposes of discussion that this ratio has a value of about 17.5 p.u. and is therefore the data point 56 shown in FIG. 2 of the drawings. In view of the fact that this particular ratio derives from the ratio circuit $\mathbf{40}_{16}$, the data point determined by it is in the region of FIG. 2 which is above the line at 54. Since the apparent value of porosity is then known, the actual value is determined by the correction circuit $\mathbf{42}_{16}$ and in this instance, is a value of 10.0 p.u. Assume for purposes of illustration that the ratio circuit $\mathbf{40}_{16}$ provides an output of 32 p.u. which is indicated by the data point 58 in FIG. 2 of the drawings. This measure of apparent porosity correlates to an actual porosity measure at 60 which is about 24 p.u. As will be understood, the same type of extrapolation described for the ratio circuit $\mathbf{40}_{16}$ and the correction circuit $\mathbf{42}_{16}$ can be implemented in the other correction circuits 42 so that the entire family of curves necessary to implement FIG. 2 conversion from apparent porosity to actual porosity is then executed. That in turn enables the N/F ratio from two counters to be converted into porosity from the N/F ratio (see FIG. 3). In the example given where n is sixteen, sixteen N/F ratios may be output from the sixteen ratio circuits at 40: the 16 values may be used to obtain a straight average which represents average porosity, or certain of the N/F ratios can be reduced in importance by weighting factors attached to the sixteen ratios.

The clock enables the ratio circuits to operate periodically, and after each operation, the two sets of counters at 36 and 38 can be zeroed. This can be repeated as often as desired depending on the scale factors including the speed of rotation of the drill string, the timing at which standoff is measured, the duration of the standoff measurements and other scale factors of a similar nature.

While the foregoing is directed to the preferred embodiment, the scope thereof is determined by the claims which follow.

What is claimed is:

1. A method of determining corrected porosity in an MWD porosity measuring system which comprises the steps of:

a ) repetitively measuring the porosity during the rotation of the drill string utilizing a radioactive source cooperative with near and far gamma ray detectors to obtain plural indications of apparent porosity;

b) repetitively measuring during the operation of the source and detectors the standoff of the source and detectors relative to the sidewall of the well borehole wherein the expected total range of standoff values is divided into n separate intervals and n values of apparent porosity are determined, to obtain n plural standoff measurements; and c) as a function of measured standoff, correcting said n apparent porosity indications to obtain corresponding n values of corrected porosity.

2. The method of claim 1 wherein n is a whole number positive integer of 2 or more and counts from the detectors are stored in assigned counters into which detailed gamma ray counts are formed while the measured value of standoff is in each of said n separate standoff intervals.

3. The method of claim 1 including the step of defining the range of standoff into n equal intervals.

4. The method of claim 3 including the step measuring near and far detector gamma ray count ratios for each of the n intervals.

5. A method of measuring porosity with a porosity tool in a MWD system having a radioactive source and near and far spaced gamma ray detectors cooperatively arranged in the MWD porosity measuring apparatus wherein the method comprises;

(a) during rotation, radially measuring outwardly from the MWD porosity measuring tool a value of standoff from the tool to the surrounding well borehole wall;

(b) measuring gamma ray counts during rotation from the near and far spaced gamma ray detectors wherein the counts measured are stored in near detector and far detector associated counter arrays;

(c) dependent on variations in standoff directing the counts from the near and far detectors into different counter sets within said near and far detector associated counter arrays; and (d) accumulating over a period of time counts in a first counter set for the near and far detectors, and also a second counter set associated with near and far spaced gamma ray detectors wherein the gamma ray counts are assigned to the counter sets based on dynamically measured standoff.

6. The method of claim 5 wherein standoff is divided into n defined intervals, and the first and second counter sets are enabled for operation only when standoff is measured to be within one of said n defined intervals of standoff.

* * * * *

UNITED STATES PATENT AND TRADEMARK OFFICE

CERTIFICATE OF CORRECTION

PATENT NO. : 5,357,797

DATED : October 25, 1994

INVENTOR(S) : Voldi E. Maki, Jr., et. al.

It is certified that error appears in the above-indentified patent and that said Letters Patent is hereby corrected as shown below:

Column 3, line 24, change "straighten" to --straightens--.
Column 3, line 33, delete "." after understood and insert --,--.
Column 4, line 68, change "3616" to --$36_{16}$--and --$38_{16}$--.

Signed and Sealed this

Twenty-eight Day of March, 1995

*Attest:*

Bruce Lehman

BRUCE LEHMAN

*Attesting Officer*

*Commissioner of Patents and Trademarks*